US007881624B2

(12) United States Patent
Kweon et al.

(10) Patent No.: US 7,881,624 B2
(45) Date of Patent: Feb. 1, 2011

(54) DEVELOPER CARTRIDGE, DEVELOPING UNIT AND IMAGE FORMING APPARATUS HAVING THE SAME

(75) Inventors: Dae-Seob Kweon, Suwon-si (KR); Jean-Man Sur, Suwon-si (KR); Joo-Hwan Noh, Yongin-si (KR)

(73) Assignee: Samsung Electronics Co., Ltd, Suwon-si (KR)

( * ) Notice: Subject to any disclaimer, the term of this patent is extended or adjusted under 35 U.S.C. 154(b) by 162 days.

(21) Appl. No.: 12/240,686

(22) Filed: Sep. 29, 2008

(65) Prior Publication Data

US 2009/0214230 A1 Aug. 27, 2009

(30) Foreign Application Priority Data

Feb. 22, 2008 (KR) ..... 10-2008-0016464

(51) Int. Cl.
*G03G 15/08* (2006.01)

(52) U.S. Cl. ..... 399/27; 399/262; 399/263

(58) Field of Classification Search ..... 399/24, 399/25, 27, 107, 111, 119, 120, 252, 258, 399/262, 263; 222/DIG. 1
See application file for complete search history.

(56) References Cited

U.S. PATENT DOCUMENTS

| | | | | |
|---|---|---|---|---|
| 4,967,234 | A | 10/1990 | Tani et al. | |
| 4,974,020 | A | 11/1990 | Takamatsu et al. | |
| 4,977,429 | A | 12/1990 | Tani et al. | |
| 5,479,247 | A | 12/1995 | Watanabe et al. | |
| 5,493,366 | A | 2/1996 | Satoh et al. | |
| 5,499,077 | A | 3/1996 | Endo et al. | |
| 5,589,915 | A | 12/1996 | Hashimoto | |
| 5,960,238 | A | 9/1999 | Ohgami | |
| 6,041,212 | A | 3/2000 | Okada | |
| 6,104,888 | A | 8/2000 | Kobayashi | |
| 6,151,459 | A | 11/2000 | Hashimoto et al. | |
| 6,226,464 | B1 * | 5/2001 | Suwa et al. | 399/27 |
| 6,792,230 | B2 | 9/2004 | Saito et al. | |
| 6,892,036 | B2 * | 5/2005 | Ito | 399/27 |
| 6,980,758 | B2 | 12/2005 | Murayama et al. | |

(Continued)

FOREIGN PATENT DOCUMENTS

EP 0 570 993 A1 11/1993

(Continued)

OTHER PUBLICATIONS

English Language abstract of KR 91-1489, published Jan. 31, 1991.

(Continued)

*Primary Examiner*—Hoan Tran
(74) *Attorney, Agent, or Firm*—Stanzione & Kim, LLP

(57) ABSTRACT

A developer cartridge includes a cartridge body including a developer discharge port, a remaining developer detecting unit arranged in the proximity to the developer discharge port, and an agitating unit rotatably arranged inside the cartridge body to convey the developer accommodated in the cartridge body toward the developer discharge port. Since the optical sensor provided in the image forming apparatus body is capable of physically measuring an exact amount of remaining sensor of the developer cartridge, a printing error due to erroneous determination of the remaining developer amount can be prevented.

24 Claims, 7 Drawing Sheets

U.S. PATENT DOCUMENTS

| | | | | |
|---|---|---|---|---|
| 7,050,728 | B2 * | 5/2006 | Minagawa et al. | 399/27 |
| 7,340,197 | B2 | 3/2008 | Murayama et al. | |
| 2002/0085857 | A1 | 7/2002 | Kim et al. | |
| 2002/0085887 | A1 | 7/2002 | Schneider et al. | |
| 2003/0161653 | A1 | 8/2003 | Ban et al. | |
| 2004/0001723 | A1 | 1/2004 | Ashida et al. | |
| 2004/0223772 | A1 | 11/2004 | Nakazato | |
| 2005/0031386 | A1 * | 2/2005 | Fujiwara et al. | 399/328 |
| 2005/0047821 | A1 | 3/2005 | Murayama et al. | |
| 2005/0095020 | A1 | 5/2005 | Eom et al. | |
| 2005/0260011 | A1 | 11/2005 | Murayama et al. | |
| 2006/0177241 | A1 * | 8/2006 | Sato et al. | 399/254 |
| 2006/0210285 | A1 | 9/2006 | Nakazato | |
| 2006/0285880 | A1 | 12/2006 | Okabe | |
| 2007/0230999 | A1 | 10/2007 | Shimomura | |
| 2008/0056772 | A1 | 3/2008 | Utsumi et al. | |

FOREIGN PATENT DOCUMENTS

| | | |
|---|---|---|
| EP | 0 672 971 | 9/1995 |
| EP | 1 437 632 | 7/2004 |
| EP | 1 840 671 | 10/2007 |
| EP | 1 881 378 | 1/2008 |
| JP | 60-238873 | 11/1985 |
| JP | 01-091164 | 4/1989 |
| JP | 09-022177 | 1/1997 |
| JP | 10-142910 | 5/1998 |
| JP | 11-24513 | 1/1999 |
| JP | 2000-75627 | 3/2000 |
| JP | 2000-075659 | 3/2000 |
| JP | 2004-264539 | 9/2004 |
| JP | 2005-326637 | 11/2005 |
| JP | 2005-338329 | 12/2005 |
| JP | 2007-025511 | 2/2007 |
| KR | 91-1489 | 1/1991 |
| KR | 10-2001-0061976 | 7/2001 |
| KR | 10-2005-0033796 | 4/2005 |
| KR | 10-2006-0034168 | 4/2006 |
| KR | 10-2006-0128338 | 12/2006 |
| RU | 2266553 | 4/2005 |

OTHER PUBLICATIONS

Korean Office Action issued in Application No. 10-2008-0016464, mailed Feb. 6, 2009.
Korean Office Action issued in Application No. 10-2008-0016467, mailed Jan. 30, 2009.
English language abstract of KR 10-2006-0034168, published Apr. 21, 2006.
English language abstract of JP 09-022177, published Jan. 21, 1997.
Machine English language translation of JP 09-022177, published Jan. 21, 1997.
Korean Office Action issued in Application No. 10-2008-0016472, mailed Feb. 5, 2009.
English language abstract of KR 10-2005-0033796, published Apr. 13, 2005.
Korean Office Action issued in Application No. 10-2008-0016469, mailed Feb. 6, 2009.
English language abstract of KR 10-2001-0061976, published Jul. 7, 2001.
European Search Report issued in EP 09150067.8, mailed Jun. 3, 2009.
English language abstract of JP 60-238873, published Nov. 27, 1985.
English language abstract of JP 01-091164, published Apr. 10, 1989.
Office Action issued in KR 10-32008-0016469, mailed Jun. 3, 2009.
English language abstract of JP 2005-326637, mailed Nov. 24, 2005.
Machine English language translation of JP 2005-326637, mailed Nov. 24, 2005.
Notice of Allowance issued in Russian Application No. 2008148634, mailed Jan. 21, 2010.
Partial English language translation of Notice of Allowance issued in Russian Application No. 2008148634, mailed Jan. 21, 2010.
English language abstract of RU 2,266,553, published Apr. 20, 2005.
English language abstract of JP 2007-025511, published Feb. 1, 2007.
Machine English language translation of JP 2007-025511, published Feb. 1, 2007.
Korean Office Action issued in Application No. 10-2008-0016455, issued Jan. 23, 2009.
English abstract of KR 10-2006-0128338, published Dec. 14, 2006.
Office Action issued in Russian patent application No. 2008148636, mailed Oct. 28, 2009.
English language translation of Office Action issued in Russian patent application No. 2008148636, Oct. 28, 2009.
English language abstract of JP 2000-075659, published Mar. 14, 2000.
Machine English language translation of JP 2000-075659, published Mar. 14, 2000.
English language abstract of RU 2289835, published Dec. 20, 2006.
English language abstract of JP 2005-338329, published Dec. 8, 2005.
Machine English language translation of JP 2005-338329, published Dec. 8, 2005.
Machine English language translation of JP 10-142910, published May 29, 1998.
Machine English language translation of JP 11-24513, published Jan. 29, 1999.
Machine English language translation of JP 2000-75627, published Mar. 14, 2000.
European Search Report issued in European Application No. 09 15 0141, mailed Apr. 14, 2009.
European Search Report Issued in European Application No. 09 15 0066, mailed Jul. 29, 2009.
European Search Report Issued in European Application No. 09 15 2590, mailed Aug. 17, 2009.
European Search Report issued in EP 09 15 0144, issued Jan. 22, 2010.
English language abstract of JP 2004-264539, published Sep. 24, 2004.
Machine English language translation of JP 2004-264539, published Sep. 24, 2004.
Office Action issued in Russian patent application No. 2008148667, mailed Dec. 11, 2009.
English language translation of Office Action issued in Russian patent application No. 2008148667, mailed Dec. 11, 2009.

* cited by examiner

DEVELOPER CARTRIDGE, DEVELOPING UNIT AND IMAGE FORMING APPARATUS HAVING THE SAME

CROSS-REFERENCE TO RELATED APPLICATION

This application claims priority from Korean Patent Application No. 2008-0016464, filed Feb. 22, 2008, in the Korean Intellectual Property Office, the entire disclosure of which is hereby incorporated by reference.

BACKGROUND OF THE INVENTION

1. Field of the Invention

The present invention relates to an image forming apparatus, and more particularly to a developer cartridge capable of indicating the amount of remaining developer, and a developing unit and an image forming apparatus having the developer cartridge.

2. Description of the Related Art

An image forming apparatus such as, e.g., an electrographic laser printer, generally uses a dry-type developer, such as a powder developer, to develop an image. The amount of remaining developer inside a developer cartridge is checked to control the developing system and also to alert the user when it is time to replace the cartridge.

The powder developer is generally held in the developer cartridge, and typically requires an agitation in the developer cartridge. As the developer powder is caused to be moved around in the developer cartridge, sometimes resulting in a large amount of developer being moved to a particular location within the developer cartridge, it becomes difficult to measure with reasonable accuracy the amount of remaining developer in a developer cartridge when the measurement is taken from limited locations.

A suggestion has been made to estimate the amount of the developer remaining, based on the amount of printing that had been performed. For example, a devoted control unit may be provided to calculates an area of an electrostatic latent image formed on a photosensitive medium to estimate the amount of developer required to develop the electrostatic latent image. That is, the control unit may estimate an amount of required developer to print out one sheet of printing medium, and may keep track of an estimate of the amount of developer that may have been used, and thus estimates the amount of developer that may be remaining in the developer cartridge.

However, since the above method is based on an indirect estimation, there often is a discrepancy between the estimate and the actual used amount. For example, the actual amount of remaining developer may generally turn out to be smaller than the estimated amount as some additional amount of developer may have been actually used due to, e.g., developer leakage, loss, or the like during printing operations. Such less than accurate estimate may result in images being printed with less density, or even failing to be printed.

BRIEF DESCRIPTION OF THE DRAWINGS

Various features and advantages of the disclosure will become more apparent by the following detailed description of several embodiments thereof with reference to the attached drawings, of which.

DETAILED DESCRIPTION OF SEVERAL EMBODIMENTS

Figure 1:
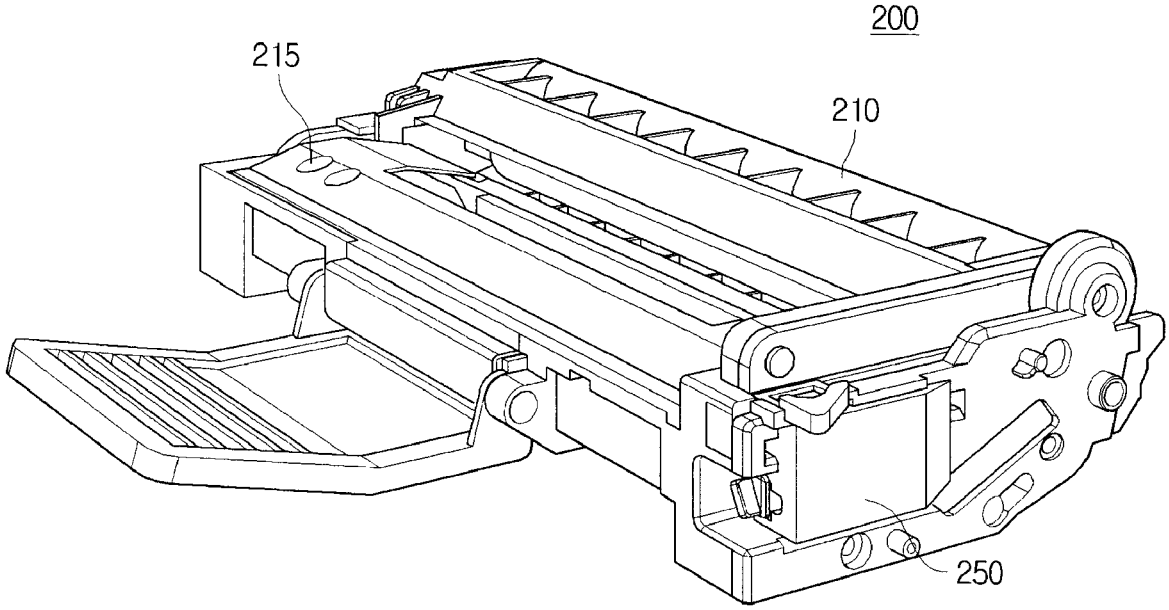
FIG. 1 is a perspective view illustrating a developing unit on which a dummy cover is mounted according to an embodiment of the invention.

In the following description, the same drawing reference numerals are used for the same elements in all drawings. The matters defined in the description, such as detailed construction and elements, are provided to assist in a comprehensive understanding of the invention. Thus, it should be apparent that the exemplary embodiments of the invention can be carried out without those specifically detailed matters. Also, well-known functions or constructions are not described in detail so as to avoid obscuring the description with unnecessary detail.

Figure 2:
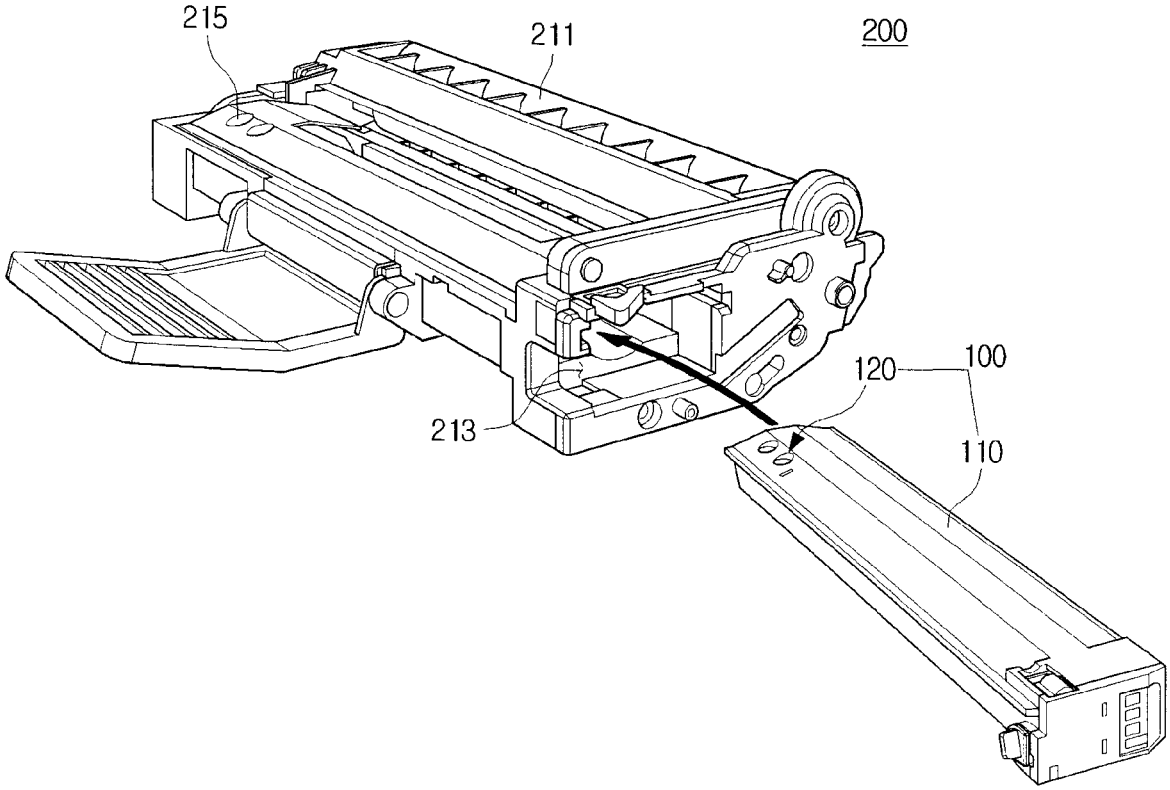
FIG. 2 is a perspective view illustrating a developer cartridge being mounted in a developing unit according to an embodiment of the invention.
Figure 3:
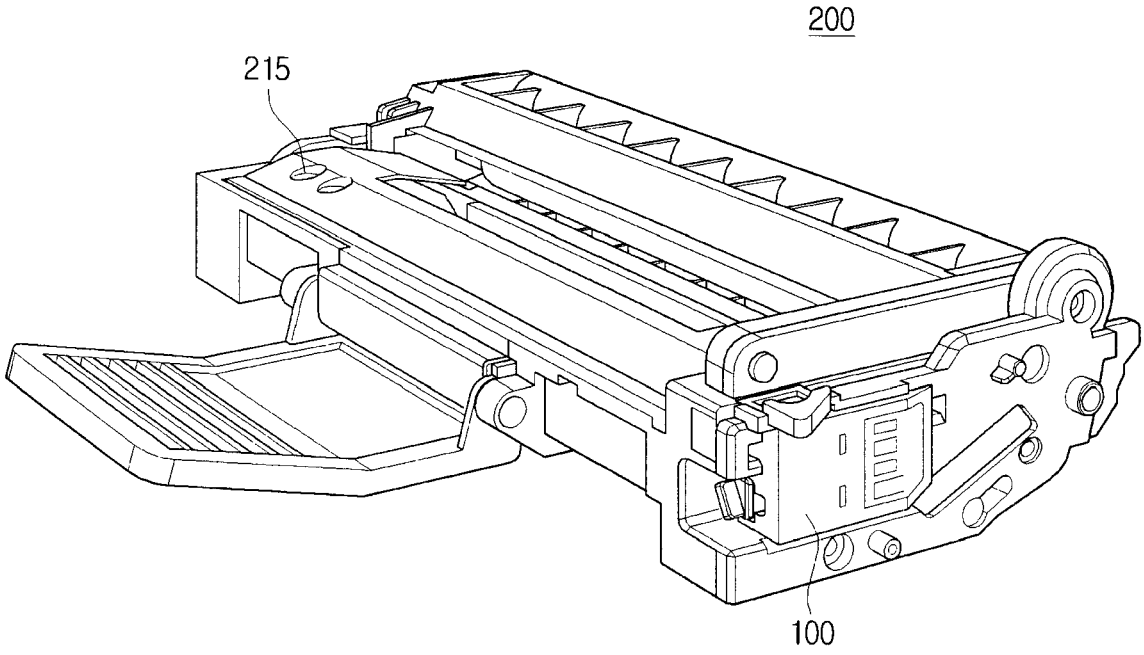
FIG. 3 is a perspective view illustrating a developing unit in which a developer cartridge is mounted according to an embodiment of the invention.

Referring to FIG. 1, a developing unit 200 may initially contain developer in a developing cartridge 210 when shipped. In one embodiment the developing cartridge 210 has a mounting cavity 213 (FIG. 2), and the opening of the mounting cavity 213 may be sealed with a dummy cover 250. When a user wishes to refill the developing unit 200 with developer, the dummy cover 250 may be removed, and a replacement developer cartridge 100 may be installed in the mounting cavity 213 to replenish the developer. An example of the replacement operation is illustrated in FIG. 2 while the developing unit 200 is shown with developer cartridge 100 installed in FIG. 3.

Figure 4:
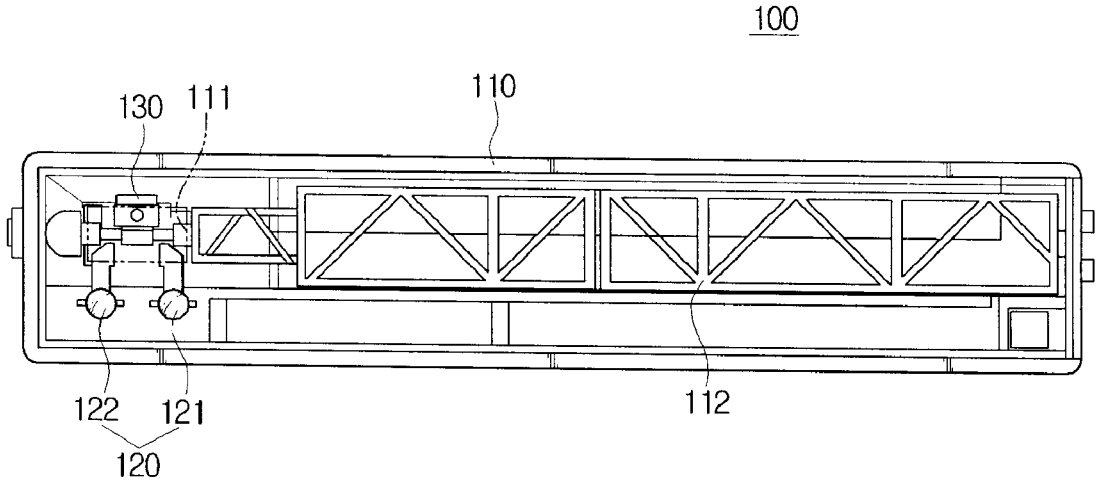
FIG. 4 is a transverse cross-section view of a developer cartridge containing a remaining developer detecting unit according to an embodiment of the invention.

Referring to FIG. 4, the developer cartridge 100 according to an embodiment of the invention may include a cartridge body 110 and a remaining developer detecting unit 120. The cartridge body 110 may include a developer discharge port 111 formed on the bottom adjacent to a front end of the cartridge body 110, where the front end may be, e.g., the end of the cartridge body 110 inserted first into the developing unit 200 during installation (see FIG. 2). The developer discharge port 111 may alternatively be disposed in a different location on the cartridge body 110. The cartridge body 110 contains developer and may also house an agitating unit 112 to agitate and/or to convey the developer.

Figure 8:
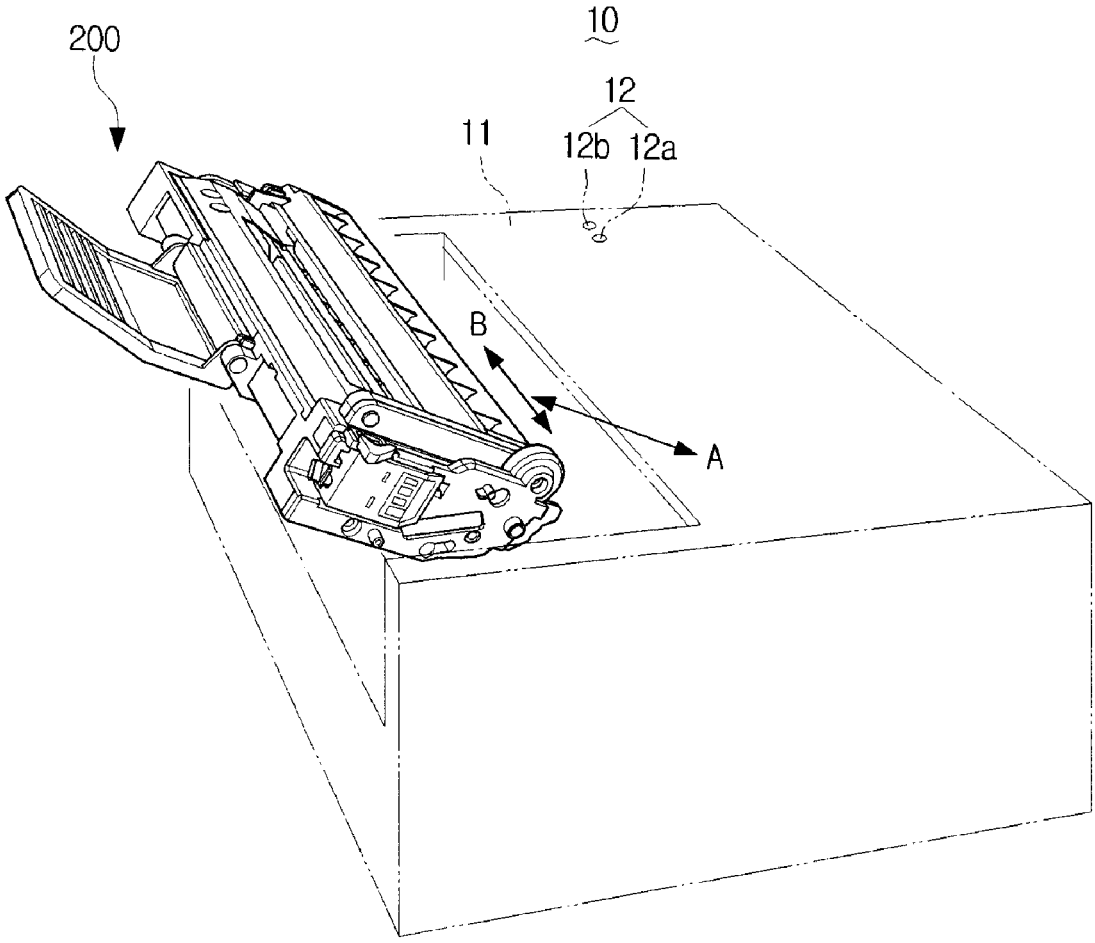
FIG. 8 is a perspective view illustrating a process in which a developing unit is received in an image forming apparatus according to an embodiment of the invention.

In one embodiment of the invention, the remaining developer detecting unit 120 may be arranged directly above the developer discharge port 111. Other embodiments may allow the remaining developer discharge unit 120 to be located in another area within the cartridge body 110. The remaining developer detecting unit 120 may be made from a light permitting material to guide a path of light. As seen in FIG. 8, the light path may be an optical path between a light emitting unit 12*a* and a light receiving unit 12*b* of an optical sensor 12 formed on a body 10 of an image forming apparatus. Alternatively, light may be sourced by a light emitting unit disposed on the cartridge body 110 itself or the developing cartridge 210, or it may come from another source at a different location within the image forming apparatus.

Figure 5:
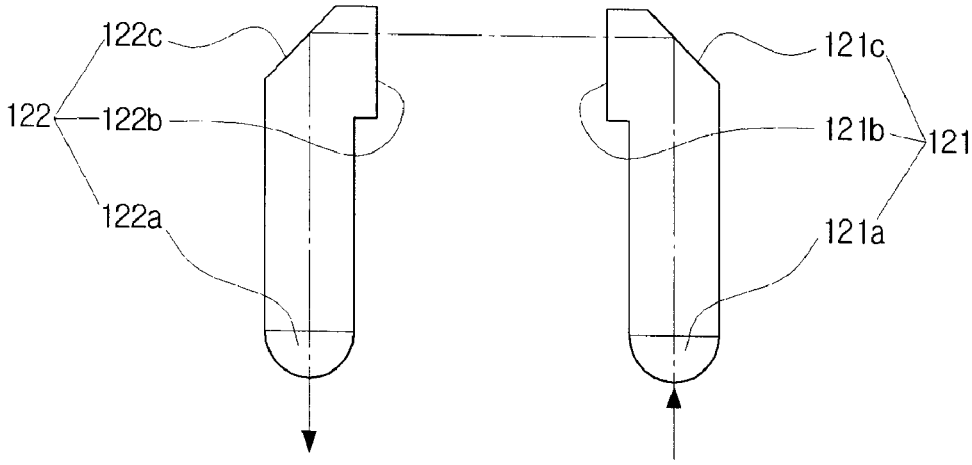
FIG. 5 illustrates an optical path passing through a remaining developer detecting unit of FIG. 4 according to an embodiment of the invention.

FIG. 5 is provided to explain an operational principle of the remaining developer detecting unit 120 (see FIG. 4) according to an embodiment of the invention. The remaining developer detecting unit 120 includes a first optical guide 121 and a second optical guide 122. The first optical guide 121 includes a light entry portion 121*a* formed on one end to face a light source, e.g., the light emitting unit 12*a* of the optical sensor 12, and a first light transfer surface 121*b* formed on the other end. A first reflective surface 121*c* is arranged on an optical path between the light entry portion 121*a* and the first light transfer surface 121*b*.

The second optical guide 122 includes a light exit portion 122*a* formed on one end to face a light sensor, e.g., the light receiving unit 12*b* of the optical sensor 12, and a second light transfer surface 122*b* formed on the other end. A second reflective surface 122*c* may be arranged on an optical path between the light exit portion 122*a* and the second light transfer surface 122*b*.

The light entry portion 121*a* and the light exit portion 122*a* may be arranged in a co-planar relation, so that parallel optical paths can be formed to pass the light to enter or exit the light entry portion 121*a* and the light exit portion 122*a*. The first and second light transfer surfaces 121*b* and 122*b* may be arranged to face each other at a predetermined distance. The first and second light transfer surfaces 121*b* and 122*b* may desirably be arranged directly above the developer discharge port 111 to measure the amount of remaining developer.

The first and second reflective surfaces 121*c* and 122*c* may be arranged to cause the light entry portion 121*a* and the light exit portion 122*a* to be oriented in a co-planar relation. The first reflective surface 121*c* reflects a light toward the second light transfer surface 122*b* via the first light transfer surface 121*b*, and the second reflective surface 122*c* reflects the light received at the second light transfer surface 122*b* toward the light exit portion 122*a*. In one embodiment of the invention, the first and second light reflective surfaces 121*c* and 122*c* may be arranged so that the angle at which the light enters is at 45° from the angle at which the light is reflected. Two or more first and second reflective surfaces 121*c* and 122*c* may also be employed in alternate embodiments of the invention.

Figure 6:
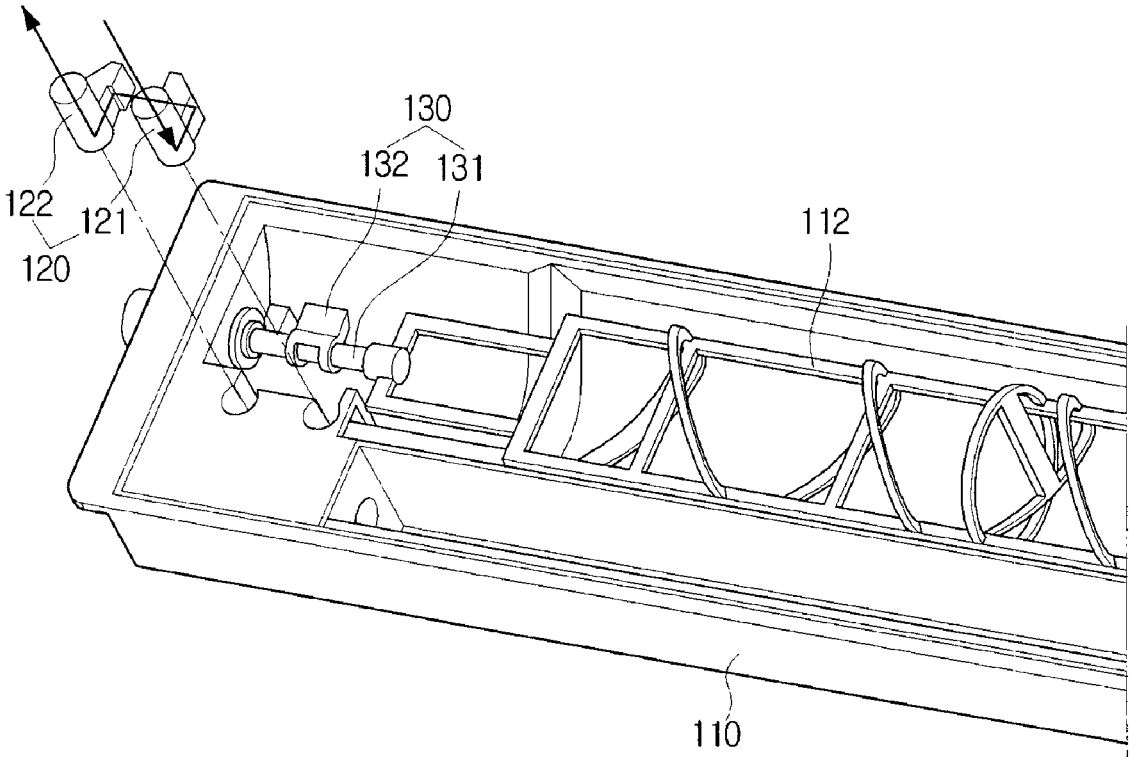
FIG. 6 is a perspective view illustrating a developer cartridge according to an embodiment of the invention.

For example. FIG. 6 illustrates an embodiment in which two first reflective surfaces 121*c* and two second reflective surfaces 122*c* are employed, thereby forming the optical paths indicated by the arrows.

Referring to FIG. 6, in one embodiment of the invention, a cleaning unit 130 may be employed between the first and second light transfer surfaces 121*b* and 122*b* to clean the facing surfaces of the first and second light transfer surfaces 121*b* and 122*b*. The cleaning unit 130 is rotatably arranged inside the cartridge body 110 to rotate about the shaft of the agitating unit 112, which rotates to agitate and/or convey the developer of the cartridge body 110 toward the developer discharge port 111.

The cleaning unit 130 may include a rotating axis 131 and a cleaning member 132. Referring to FIG. 6, the rotating axis 131 utilizes the rotating axis of the agitating unit 112. Alternatively the rotating axis 131 may be arranged to rotate along its own axis. The cleaning member 132 may be rotated to wipe the facing surfaces of the first and second light transfer surfaces 121*b* and 122*b* concurrently, or in the alternative, in an alternating manner. The cleaning member 132 may be made from, e.g., urethane material, silicon rubber, sponge-type foam, films such as polyethylene terephthalate (PET) sheets, or other appropriate material.

The cleaning member 132 may be rotated between a first position and a second position, in which the cleaning member 132 in the first position is brought into contact with the facing surfaces of the first and second light transfer surfaces 121*b* and 122*b* to wipe out the facing surfaces, and the cleaning member 132 in the second position is positioned away from the first and second light transfer surfaces 121*b* and 122*b* so as not to interfere with the optical path of the light passing through the first and second light transfer surfaces 121*b* and 122*b*.

In one embodiment of the invention, the surface of the light entry portion 121*a* that faces the light source (such as the light emitting unit 12*a* of the optical sensor 12) and the surface of the light exit portion 122*a* that faces the light receiving unit (such as the light receiving unit 12*b* of the optical sensor 12), may be formed as circular convex lenses in order to improve the sensitivity.

Figure 7:
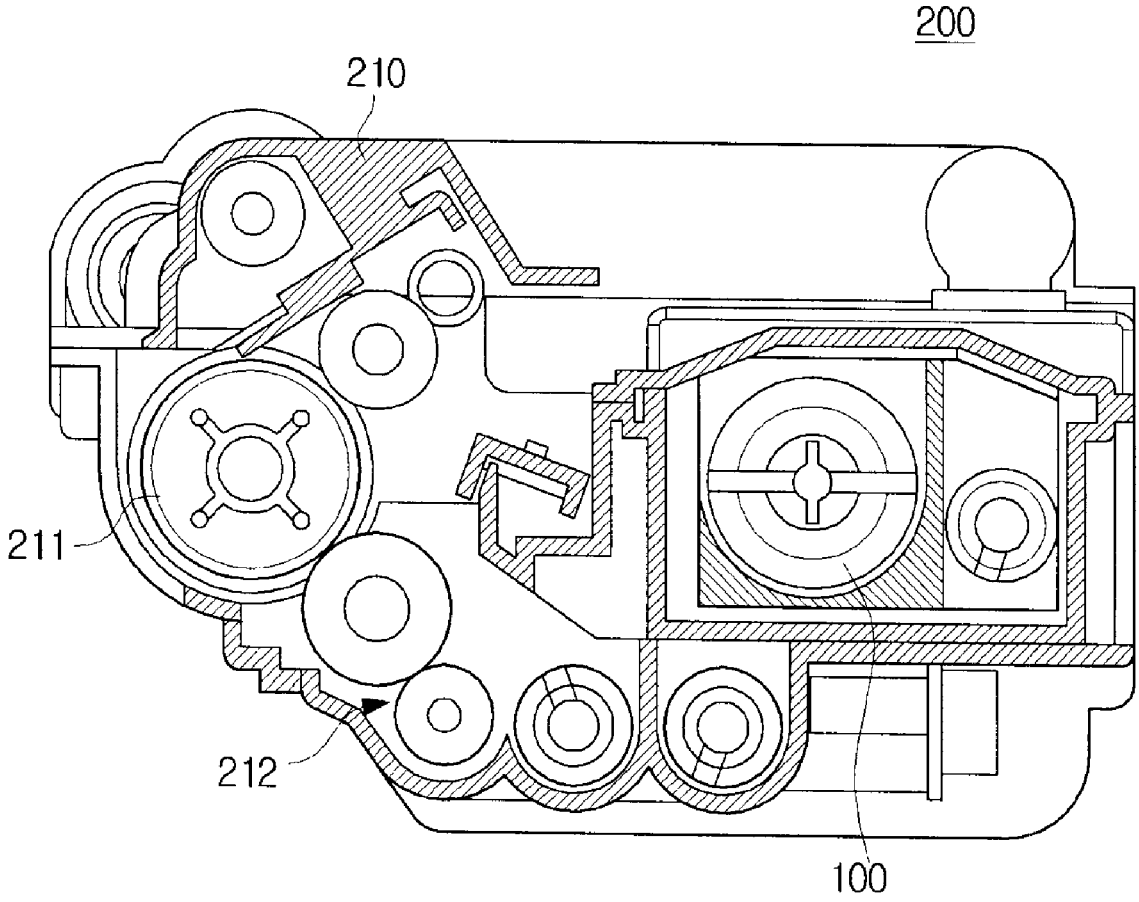
FIG. 7 is a cross-section view of the developing unit in which a developer cartridge is mounted according to an embodiment of the invention from FIG. 3.

Referring to FIG. 7, the developing unit 200 according to an embodiment of the present invention may include a developing cartridge 210, and a developer cartridge 100, which is configured in the manner explained above, and which may be removably received in the developing cartridge 210 as shown in FIG. 2.

The developing cartridge 210 may include a photosensitive medium 211, a developer feeding unit 212 to feed the developer to the photosensitive medium 211, and a cartridge receiving recess 213 (FIG. 2) in which the developer cartridge 100 is removably received. In one embodiment of the invention, the developing cartridge 210 may include a sensor hole 215 (FIGS. 1 and 2) formed on a location to correspond to the remaining developer detecting unit 120 of the developer cartridge 100. According to an embodiment, the sensor hole 215 may be arranged in a circular configuration having the same diameter as the light entry portion 121*a* and the light exit portion 122*a*.

Referring to FIG. 8, according to an embodiment of the invention, an optical sensor 12 may be installed in a main body 11 of an image forming apparatus 10. A developing unit 200, which is constructed in the manner explained above, may be removably received in the main body 11. The direction B in which the developer cartridge 100 is received in the developing unit 200 and removed from the developing unit 200 is in perpendicular relation to the direction A in which the developing unit 200 is received in the image forming apparatus 10 and removed from the image forming apparatus 10.

For the sake of brevity, only the relevant portions of the image forming apparatus 10 and the developing unit 200 will be explained in detail below.

Referring to FIG. 1, the developing unit 200 is installed in the cartridge receiving recess 213 (FIG. 2), and the opening of the cartridge receiving recess 213 is sealed with the dummy cover 250, for example when the image forming apparatus is shipped from the factory. Printing may still be carried out using the developer contained within the developer feeding unit 212 (FIG. 7), which may hold an initial supply of developer, for example, sufficient amount for printing, e.g., approximately thousand sheets of paper. When a user wishes to replenish the developer supply, the user may remove the dummy cover 250 to insert a replacement developer cartridge 100 in the cartridge receiving recess 213 (FIG. 2).

In one embodiment of the invention, when the developer cartridge 100 is inserted in the cartridge receiving recess 213, the optical sensor 12, arranged inside the image forming apparatus 10, faces the remaining developer detecting unit 120 through the sensor hole 215, so that the light emitting unit

12*a* of the optical sensor 12 faces the first optical guide 121, and the light receiving unit 12*b* of the optical sensor 12 faces the second optical guide 122. In alternative embodiments of the invention, an optical sensor may be disposed in place of the sensor hole 215 on the developing unit 200, or an optical sensor may be disposed on the developer cartridge 100 facing the first optical guide 121 and the second optical guide 122.

When the developer cartridge 100 is installed within the cartridge receiving recess 213, the developer discharge port 111 is open, and a developer inlet port (not shown) of the developing unit 200 is also open. As a result, the developer of the developer cartridge 100 is fed into the developer feeding unit 212 of the developing unit 200.

In one embodiment of the invention, when the developing unit 200 housing the developer cartridge 100 is received in the image forming apparatus 10, the direction in which the developer cartridge 100 is inserted in the developing unit 200 and removed from the developing unit 200 may be in perpendicular relation with respect to the direction in which the developing unit 200 is inserted in the image forming apparatus 10 and removed from the image forming apparatus 10.

In one embodiment of the invention, a control unit (not shown) of the image forming apparatus 10 may cause a light beam to be emitted to the remaining developer detecting unit 120 using the optical sensor 12, to determine whether the developer of the developer cartridge 100 is used up. The light emitting unit 12*a* of the optical sensor 12 emits a light beam to the first optical guide 121, and the emitted light is transferred toward the second optical guide 122 selectively depending on the amount of remaining developer.

For example, if the amount of remaining developer of the developer cartridge 100 is above a predetermined level, the developer fills up the space between the facing surfaces of the first and second light transfer surfaces 121*b* and 122*b*, thereby blocking light from passing from the first optical guide 121 to the second optical guide 122. As a result, in one embodiment of the invention the light receiving unit 12*b* of the optical sensor 12 fails to receive the light beam emitted from the light emitting unit 12*a*. In this situation, the optical sensor 12 emits a sensing signal to indicate that a sufficient amount of developer is remaining to the control unit of the image forming apparatus 10. Although, if a cleaning unit 130 is provided, the same may rotate, e.g., with the rotation of the agitating unit 112, thereby constantly wiping out the facing surfaces of the first and second light transfer surfaces 121*b* and 122*b*, the developer will quickly fill in the space between the first and second light transfer surfaces 121*b* and 122*b* to block the light beam from being passed from the first optical guide 121 to the second optical guide 122.

If the remaining developer in the developer cartridge 100 is substantially depleted, light emitted is passed through the optical entry portion 121*a*, and reflected against one of more first reflective surface 121*c* to be emitted to the first light transfer surface 121*b*, and the reflected light is passed through the empty space, enters the second light transfer surface 122*b*, and reflected against the second reflective surface 122*c*. In one embodiment of the invention, the light moves towards the light receiving unit 12*b* of the optical sensor 12 through the optical exit portion 122*a*. As a result, the light receiving unit 12*b* senses the light beam emitted from the light emitting unit 12*a*, and the optical sensor 12 outputs a signal to the control unit of the image forming apparatus 10 to indicate that the developer of the developer cartridge 100 has been substantially depleted.

Since, in an embodiment, the cleaning unit 130 continuously rotates along with the agitating unit 112 to wipe out the facing surfaces of the first and second light transfer surfaces 121*b* and 122*b*, the space between the first and second optical guides 121 and 122 is emptied when the developer is used up. Accordingly, the light passes from the first light transfer surface 121*b* to the second light transfer surface 122*b*.

As explained above, from the fact that the light beam emitted to the first optical guide 121 is blocked from being transferred to the second optical guide 122 in the presence of the developer, but is transferred to the second optical guide 122 in the absence of the developer, whether or not the developer remains in the developer cartridge 100 may be determined. To this end, according to an embodiment, the image forming apparatus 10 may include a controller (not shown), which may be, e.g., a microprocessor, a microcontroller or the like, that includes a CPU to execute one or more computer instructions, e.g., to receive signal(s) from the optical sensor 12, to determine base on the received signal(s) whether sufficient amount of developer remains in the developer cartridge, and to control the image forming apparatus appropriately, e.g., to alert the user that replenishment of developer is needed, and may further include a memory device, e.g., a Random Access Memory (RAM), Read-Only-Memory (ROM), a flesh memory, or the like, to store the one or more computer instructions.

In one embodiment of the invention the first and second light transfer surfaces 121*b* and 122*b* may be arranged in the proximity to the developer discharge port 111. For example, the first and second light transfer surfaces 121*b* and 122*b* may be arranged directly above the developer discharge port 111, as illustrated in FIG. 4. The space between the first and second light transfer surfaces 121*b* and 122*b* is detected most accurately when the first and second light transfer surfaces 121*b* and 122*b* are arranged as close as possible to the developer discharge port 111. If the first and second light transfer surfaces 121*b* and 122*b* are arranged away from the developer discharge port 111, the optical sensor 12 may erroneously determine that the developer is used up while there is still developer inside the developer cartridge 100. However, if other design considerations make placement of the first and second light transfer surfaces 121*b* and 122*b* away from the developer discharge port 111 desirable, the invention may still be practiced in such a design.

According to one aspect of the invention, the optical sensor 12 may detect the amount of the remaining developer of the developer cartridge 100 as well as the presence/absence of the developer. As the developer recedes over time, the developer ripples, particularly at the areas contacting the ends of the first and second optical guides 121 and 122, while being conveyed toward the developer discharge port 111 due to the movement of the agitating unit 112. As the developer ripples, the space between the first and second optical transfer surfaces 121*b* and 122*b* is occasionally emptied, thereby intermittently passing the light beam from the first optical guide 121 towards the second optical guide 122. As a result, the light receiving unit 12*b* of the optical sensor 12 may receive the light beam from the light emitting unit 12*a*.

The relation between the amount of remaining developer and the number of occasions that the light beam passing the first optical guide 121 reaches the second optical guide 122, can be defined. For example, if it is established according to an embodiment of the invention, that the light beam passing the first optical guide 121 arrives at the second optical guide 122 two times per second when the remaining developer amount is approximately 50% of the full level, the optical sensor 12 may determine that the amount of the remaining developer is 50% of the full level based on the fact that the optical sensor 12 detects the light beam from the light emitting unit 12*a* arriving at the light receiving unit 12*b* two times per second. Other embodiments may have different relations between remaining developer and number of times the light beam travels through the remaining developer detecting unit 120, and the 50% full at two times per second relationship is only disclosed as an example. By storing a database of the sensed signals of the optical sensor 12 according to different levels of the developer, the amount of remaining developer inside the developer cartridge 100 can be determined.

While an embodiment of the invention employs the optical sensor 12 to detect the amount of the remaining developer, it should be understood that the main object of the present invention is to provide a sensor to detect the amount of remaining developer in the developer cartridge 110.

Accordingly, not only the optical sensor 12, but also other types of sensors that can detect the developer amount can be employed. For example, a piezo sensor may be arranged in the proximity to the developer discharge port to measure the amount of remaining developer based on the weight and vibration of the developer. Alternatively, considering that the developer is generally a conductive material, a capacitance type sensor may be employed, in which a plurality of electrodes are arranged near the developer to detect the electric current flowing the electrodes or the difference of the voltages. A sensor to physically detect the amount of the remaining developer may also be arranged.

The foregoing embodiments and advantages are merely examples and are not to be construed as limiting the present invention. The present teaching can be readily applied to various other embodiments. Also, the description of the embodiments of the present invention is intended to be illustrative, and not to limit the scope of the claims, and many alternatives, modifications, and variations will be apparent to those skilled in the art.

What is claimed is:

1. A developer cartridge, comprising:

a cartridge body comprising a developer discharge port;

a remaining developer detecting unit arranged in proximity of the developer discharge port; and an agitating unit rotatably arranged inside the cartridge body to convey the developer accommodated in the cartridge body toward the developer discharge port, wherein the remaining developer detecting unit comprises:

a first optical guide comprising a light entry portion arranged on one end to face a light emitting unit of an optical sensor arranged outside of the developer cartridge, and a first light transfer surface formed on the other end; and a second optical guide comprising a light exit portion arranged on one end to face a light receiving unit of the optical sensor, and a second light transfer surface formed on the other end, wherein the first and second light transfer surfaces are arranged to face each other at a predetermined distance from each other with the first and second light transfer surfaces being located inside the cartridge body, the first optical guide comprising one or more reflective surface to reflect the light beam emitted from the light emitting unit towards the second light transfer surface via the first light transfer surface, and the second optical guide comprises one or more second reflective surface to reflect the light beam received at the second light transfer surface towards the light exit portion.

2. The developer cartridge of claim 1, wherein an angle of incidence and an angle of reflection of the light of the first and second reflective surfaces are approximately 45° from each other.

3. The developer cartridge of claim 1, further comprising a cleaning unit interposed between the first and second light transfer surfaces, to wipe the first and second light transfer surfaces.

4. The developer cartridge of claim 3, wherein the cleaning unit is rotated together with the agitating unit.

5. The developer cartridge of claim 3, wherein the cleaning unit comprises:

a rotating axis that rotate together with the agitating unit; and a cleaning member arranged on the rotating axis to wipe the first and second light transfer surfaces in a rotating motion.

6. The developer cartridge of claim 5, wherein the cleaning member is rotated between a first position and a second position, in which the cleaning member in the first position is brought into contact with, and to thereby wipe, the first and second light transfer surfaces, the cleaning member in the second position being away from the first and second light transfer surfaces so as not to interfere with an optical path of the light bean passing through the first and second light transfer surfaces.

7. The developer cartridge of claim 1, wherein the first and second light transfer surfaces are arranged above the developer discharge port.

8. The developer cartridge of claim 1, wherein the surface of the light entry portion that faces the light emitting unit of the optical sensor and the surface of the light exit portion that faces the light receiving unit of the optical sensor are each formed as a circular convex lens.

9. The developer cartridge of claim 1, wherein the developer cartridge is detachably received into a developing cartridge of an image forming apparatus, the developer discharge port being formed at a bottom of the cartridge body, and in proximity of a front end with respect to a direction of inserting the cartridge body into the developing cartridge.

10. A developing unit, comprising:

a developing cartridge; and a developer cartridge removably received in the developing cartridge, the developer cartridge comprising, a developer discharge port, and a remaining developer detecting unit arranged in proximity of the developer discharge port, and an agitating unit rotatably arranged inside the developer cartridge to convey developer accommodated in the developer cartridge toward the developer discharge port, wherein the developing cartridge comprises a sensor hole formed to face the remaining developer detecting unit so that the remaining developer detecting unit is exposed through the sensor hole, wherein the remaining developer detecting unit comprises:

a first optical guide comprising a light entry portion arranged on one end to face a light emitting unit of an optical sensor arranged outside of the developer cartridge, and a first light transfer surface formed on the other end; and a second optical guide comprising a light exit portion arranged on one end to face a light receiving unit of the optical sensor, and a second light transfer surface formed on the other end, wherein the first and second light transfer surfaces are arranged to face each other at a predetermined distance from each other with the first and second light transfer surfaces being located inside the cartridge body the first optical guide comprising one or more reflective surface to reflect the light beam emitted from the light emitting unit towards the second light transfer surface via the first light transfer surface and the second optical guide corn rises one or more second reflective surface to reflect the light beam received at the second light transfer surface towards the light exit portion.

11. The developing unit of claim 10, wherein the first optical guide comprises one or more first reflective surface to reflect the light beam emitted from the light emitting unit towards the second light transfer surface via the first light transfer surface, and the second optical guide comprises one or more second reflective surface to reflect the light beam received at the second light transfer surface towards the light exit portion, and wherein an angle of incidence and an angle of reflection of the light of the first and second reflective surfaces are approximately 45° from each other.

12. An image forming apparatus, comprising:

a main body comprising an optical sensor comprising a light emitting unit and alight receiving unit to detect an amount of remaining developer;

a developing cartridge removably received in the main body, the developing cartridge comprising a sensor hole formed to face the optical sensor; and a developer cartridge removably received in the developing cartridge, the developer cartridge comprising, a developer discharge port, a remaining developer detecting unit arranged, in a position proximate to the developer discharge port, and to face the optical sensor through the sensor hole when the developer cartridge is received in the developing cartridge, and an agitating unit rotatably arranged inside the developer cartridge to convey the developer accommodated in the cartridge body toward the developer discharge port, wherein the remaining developer detecting unit comprises:

a first optical guide comprising a light entry portion arranged on one end to face a light emitting unit of the optical sensor arranged on a main body of an image forming apparatus, and a first light transfer surface formed on the other end; and a second optical guide comprising a light exit portion arranged on one end to face a light receiving unit of the optical sensor, and a second light transfer surface formed on the other end, wherein the first and second light transfer surfaces are arranged to face each other at a predetermined distance from each other with the first and second light transfer surfaces being located inside the cartridge body, the first optical guide comprising one or more reflective surface to reflect the light beam emitted from the light emitting unit towards the second light transfer surface via the first light transfer surface, and the second optical guide comprises one or more second reflective surface to reflect the light beam received at the second light transfer surface towards the light exit portion.

13. A developer cartridge, comprising:

a cartridge body defining an inner volume for storing therein a quantity of developer, the cartridge body including a developer discharge port, through which the developer is discharged from the inner volume;

a developer detecting unit disposed in the inner volume at a location proximate to the developer discharge port, the developer detecting unit being configured to detect the presence of developer in the vicinity of the developer discharge port; and an agitating unit rotatably arranged inside the cartridge body to move the developer accommodated in the inner volume toward the developer discharge port, wherein the remaining developer detecting unit comprises:

a first optical guide comprising a light entry portion arranged on one end to face a light emitting unit of an optical sensor arranged outside of the developer cartridge, and a first light transfer surface formed on the other end; and a second optical guide comprising a light exit portion arranged on one end to face a light receiving unit of the optical sensor, and a second light transfer surface formed on the other end, wherein the first and second light transfer surfaces are arranged to face each other at a predetermined distance from each other with the first and second light transfer surfaces being located inside the cartridge body, the first optical guide comprising one or more reflective surface to reflect the light beam emitted from the light emitting unit towards the second light transfer surface via the first light transfer surface, and the second optical guide comprises one or more second reflective surface to reflect the light beam received at the second light transfer surface towards the light exit portion.

14. The developer cartridge according to claim 13, wherein each of an angle of incidence and an angle of reflection of the light of each of the one or more first reflective surfaces and the one or more second reflective surface is approximately 45°.

15. The developer cartridge according to claim 13, further comprising:

a cleaning member disposed in the cartridge body, the cleaning member being capable of being interposed between the first and second light transfer surfaces to wipe the developer off the first and second light transfer surfaces.

16. The developer cartridge according to claim 15, wherein:

the cleaning member rotates about an rotational axis of the agitating unit between a first position and a second position, the cleaning member in the first position being brought into contact with the first and second light transfer surfaces, the cleaning member in the second position being away from the first and second light transfer surfaces so as not to interfere with the optical path of the light between the first and second light transfer surfaces.

17. The developer cartridge according to claim 13, wherein each of the light entry portion and the light exit portions is formed as a circular convex lens.

18. A developing unit, comprising:

a developing cartridge body;

a developer feeding unit disposed in the developing cartridge body, the developer feeding unit being configured to feed developer to a photosensitive medium for developing a latent image formed on the photosensitive medium;

a developer storage chamber for storing therein a quantity of the developer, the developer storage chamber including a developer discharge port, through which the developer is discharged from the developer storage chamber to the developer feeding unit;

a developer detecting unit disposed in the developer storage chamber at a location proximate to the developer discharge port, the developer detecting unit being configured to detect the presence of the developer in the vicinity of the developer discharge port; and an agitating unit rotatably arranged inside the developer storage chamber to move the developer accommodated in the developer storage chamber toward the developer discharge port, a first optical guide comprising a light entry portion arranged on one end to face a light emitting unit of an optical sensor arranged outside of the developer cartridge, and a first light transfer surface formed on the other end; and a second optical guide comprising a light exit portion arranged on one end to face a light receiving unit of the optical sensor, and a second light transfer surface formed on the other end, wherein the first and second light transfer surfaces are arranged to face each other at a redetermined distance from each other with the first and second light transfer surfaces being located inside the cartridge body, the first optical guide comprising one or more reflective surface to reflect the light beam emitted from the light emitting unit towards the second light transfer surface via the first light transfer surface, and the second optical guide comprises one or more second reflective surface to reflect the light beam received at the second light transfer surface towards the light exit portion.

19. The developing unit according to claim 18, wherein each of an angle of incidence and an angle of reflection of the light of each of the one or more first reflective surfaces and the one or more second reflective surface is approximately 45°.

20. The developing unit according to claim 18, further comprising:

a cleaning member disposed in the developer storage chamber, the cleaning member being capable of being interposed between the first and second light transfer surfaces to wipe the developer off the first and second light transfer surfaces.

21. The developing unit according to claim 20, wherein:

the cleaning member rotates about an rotational axis of the agitating unit between a first position and a second position, the cleaning member in the first position being brought into contact with the first and second light transfer surfaces, and the cleaning member in the second position being away from the first and second light transfer surfaces so as not to interfere with the optical path of the light between the first and second light transfer surfaces.

22. The developing unit according to claim 18, wherein the light entry portion and the light exit portions are arranged to be exposed outside the developing cartridge body.

23. The developing unit according to claim 18, wherein each of the light entry portion and the light exit portions is formed as a circular convex lens.

24. The developing unit according to claim 18, wherein the developer storage chamber comprises a developer cartridge removably received in the developing unit, the developer cartridge being housed in a developer cartridge body, and wherein the light entry portion and the light exit portions are arranged to be exposed outside the developer cartridge body.

* * * * *